United States Patent [19]

Schroeder

[11] 4,220,983

[45] Sep. 2, 1980

[54] ILLUMINATED BOWSIGHT

[76] Inventor: Gary P. Schroeder, 5002 Sheboygan Ave., Madison, Wis. 53705

[21] Appl. No.: 970,366

[22] Filed: Dec. 18, 1978

[51] Int. Cl.[2] ..... F41G 1/34; F41G 1/32; F41G 1/00

[52] U.S. Cl. ..... 362/114; 33/241; 33/265; 42/15; 362/110; 362/800

[58] Field of Search ..... 362/110, 111, 114, 800; 42/15; 33/241, 265; 124/23 R

[56] References Cited

U.S. PATENT DOCUMENTS

| | | | |
|---|---|---|---|
| 3,833,799 | 9/1974 | Audet | 362/800 |
| 3,945,127 | 3/1976 | Spencer | 33/265 |
| 3,963,356 | 6/1976 | Wiklund | 33/241 |
| 3,994,072 | 11/1976 | Agnello | 33/241 |

*Primary Examiner*—Donald P. Walsh

*Attorney, Agent, or Firm*—Isaksen, Lathrop, Esch, Hart & Clark

[57] ABSTRACT

An illuminated bowsight is disclosed which includes a light-emitting diode centrally located in a sighting ring and a battery to illuminate the diode. A switching device is provided on the bowsight to selectively connect and disconnect the battery to the light-emitting diode. The switching mechanism is arranged so that no additional wiring is required other than the two leads which are normally provided on a commercially available light-emitting diode.

17 Claims, 5 Drawing Figures

ILLUMINATED BOWSIGHT

BACKGROUND OF THE INVENTION

1. Field of the Invention

The present invention relates to bowsights in general, and in particular, to bowsights which provide an illuminated sighting mark for use in sighting the bow under dim light conditions.

2. Description of the Prior Art

The prior art is generally cognizant of the use of sights and scopes for use in aiming and sighting archery bows. Examples of adjustable sights for the use in such bows are shown in U.S. Pat. Nos. 3,120,222 and 3,674,002. The prior art is also generally cognizant of the use of bowsights including some provision for a signaling lamp or light on an archery bow. Typically such a lamp or light is used to indicate that the arrow has been fully drawn upon the bow rather than as a part of the sighting device itself. Examples of bowsights using such signaling devices are shown in U.S. Pat. Nos. 3,450,122, 3,766,656, and 3,867,920. However, none of these devices serve as an illuminated sighting mark on a bow for use in dim light conditions. At least one example exists of the use of a light-emitting diode for use in aligning a gun sighting mechanism. An example of such device is shown in U.S. Pat. No. 3,994,072. In addition, at least one example exists of a telescopic archery sight in which a light located on the side of the telescope is reflected into the viewer's eye to form the appearance of a light in the general area of the target when the bow is properly aligned. An example of such a device is shown in Japanese Pat. No. 427,091 dated May 2, 1966 to O. Arthur Stiennon.

SUMMARY OF THE INVENTION

The present invention is summarized in that an illuminated bowsight includes a body member having a cavity defined therein, mounting means attached to the body member for mounting the bowsight on a bow, a sighting ring attached to the body member, a battery received in the cavity in the body member, and a light-emitting diode mounted on the bowsight so as to be centrally positioned in the sighting ring, the light-emitting diode being electrically connected to the battery to provide a visible sighting mark in dim light.

It is an object of the present invention to provide a bowsight that will provide an illuminated sighting mark for use by an archer to sight to his target in dim light conditions.

It is another object of the present invention to provide a bowsight with such a visible sighting mark in which the light used for such sighting is switchable on or off at the convenience of the archer.

It is yet another object of the present invention to provide such an illuminated bowsight in which there is a minimum of wiring and/or connectors both to minimize the cost of the device and its assembly costs, and to maximize the reliability of the bowsight.

It is an advantage of the bowsight of the present invention in that the light source used by the archer is relatively inconspicuous, and while easily visible to the archer, is invisible from the target side of the bowsight.

Other objects, advantages, and features of the present invention will become apparent from the following specification when taken in conjunction with the accompanying drawings.

DESCRIPTION OF THE PREFERRED EMBODIMENT

Figure 1:
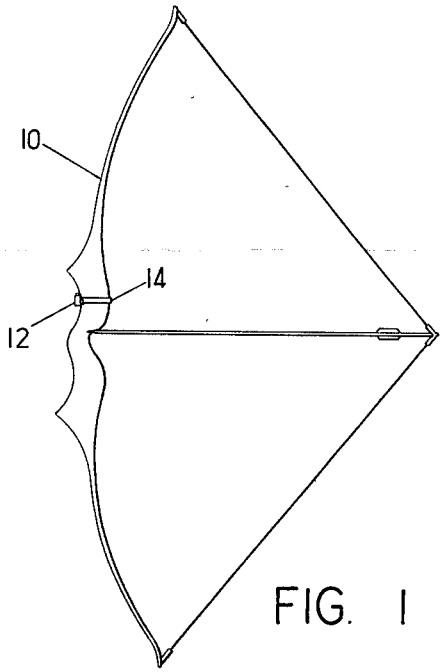
FIG. 1 is a side view of an archery bow having the bowsight of the present invention mounted on it.
Figure 2:
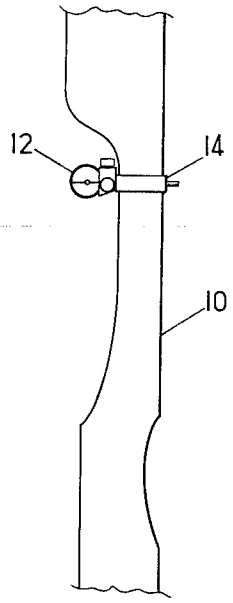
FIG. 2 is a plan view from the archer's viewpoint of the bowsight of FIG. 1 and a portion of the bow on which it is mounted.

Shown in FIGS. 1 and 2 is a bow 10 having installed on it an illuminated bowsight 12 constructed in accordance with the present invention. The bowsight 12 is attached to the bow 10 by a suitable clamp 14 and is positioned so as to extend into the field of vision of the archer.

Figure 3:
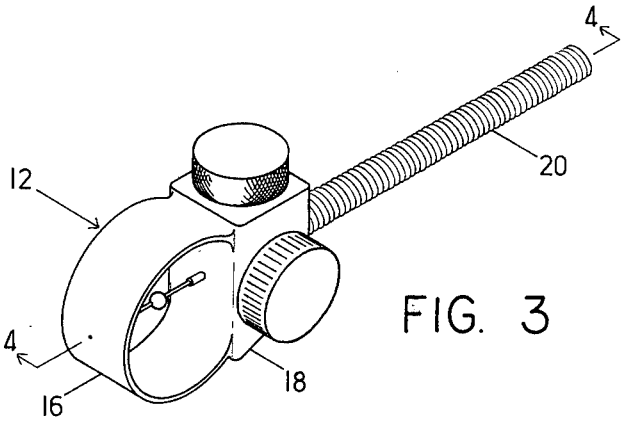
FIG. 3 is a perspective view of the bowsight of FIG. 1 alone.
Figure 4:
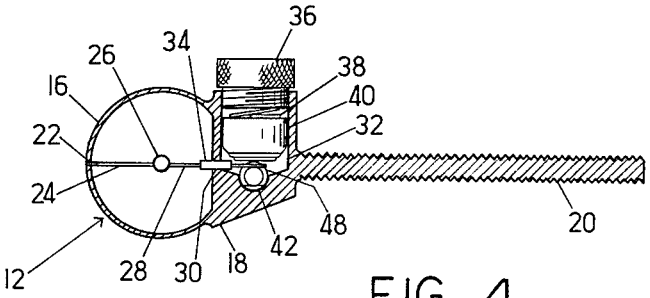
FIG. 4 is a cross-sectional view taken along the line 4—4 in FIG. 3.

As shown in FIGS. 3 and 4, the bowsight 12 includes a sighting ring 16, a body member 18 and a mounting shaft 20. The bowsight 12 is constructed of a conductive metal, such as brass, and the sighting ring 16, the body member 18 and the mounting staft 20 are cast together as one unitary piece, although they may also be optionally constructed as three separate units which are then brazed together.

The sighting ring 16 is formed as a generally circular ring of thin, flattened cross-sectional shape having a radially extending hole 22 formed through it at its outward extremity for receiving therethrough one lead 24 of an axial-lead light-emitting diode (LED) 26. The lead 24 of the LED 26 is preferably secured in the hole 22 by soldering, but a welded joint or other conductive connecting means could also be used. Another lead 28 of the LED 26 is received in a longitudinal aperture 30 formed in the body member 18.

The body member 18 also has formed in it a transversely oriented battery cavity 32 extending in a generally vertical direction downward from the top of the body member 18, the cavity 32 having a threaded portion formed at its upper end. The aperture 30 extends into the body member 18 from its side adjacent the sighting ring 16 to join the cavity 32 adjacent its lower end, the aperture 30 being axially aligned with the hole 22. The other lead 28 of the LED 26 is received through the aperture 30 and extends into the cavity 32. An insulating sleeve 34, formed of teflon, mylar, or other thin insulating material, surrounds the other lead 28 of the LED 26 as it extends through the aperture 30 to electrically insulate the other lead 28 from the body member 18. Received within the top, threaded portion of the cavity 32 is a battery cavity cap 36 which is provided with suitable threads and which is screwed into the place closing the top of the cavity 32. The bottom of the cap 36 has a concave receptacle to receive the top end of a compression spring 38 the other end of which abuts a battery 40. The battery 40 and the spring 38 are free to move within the cavity 32. The battery 40 is a conventional 1.6 volt silver-oxide hearing aid battery and the diameter of the cavity 32 is sized so as to be slightly larger than the diameter of the battery 40.

Figure 5:
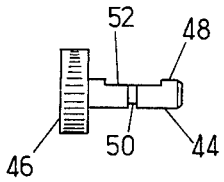
FIG. 5 is a side elevation view of the switch member of the bowsight of FIGS. 3 and 4.

Also formed in the body member 18 is a transversely oriented bore 42 which is oriented perpendicularly to both the battery cavity 32 and the aperture 30. A cammed switch member 44 is received in the bore 42 and is shown alone in greater detail in FIG. 5. The switch member 44, which is formed of a non-conductive rigid thermoplastic material, includes a knurled switch wheel 46 from the center of which extends an elongated cam shaft 48. The cam shaft 48 has an annular channel 50 formed in it extending around its periphery at a point near the general center of the cam shaft. A planar cam surface 52 is formed as a flattened, recessed section of the cam shaft 48, the cam surface 52 being generally centered about the channel 50.

As shown in FIG. 3, the cam shaft 48 of the switch member 44 is received within the bore 42. The channel 50 in the cam shaft 48 is positioned so as to receive therein the end of the other lead 28 of the LED 26 extending through the aperture 30. The end of the cam shaft 48 opposite from the switch wheel 46 extends from the other side of the body portion 18 and is deformed (not shown) into an enlarged portion to prevent the switch member 44 from being withdrawn from the bore 42.

As shown in FIG. 3, the mounting shaft 20 is an elongated, linear threaded shaft extending from one side of the body member 18. It is also envisioned that the mounting shaft could include provisions for other types of mountings or fasteners if desired.

In its operation, the bowsight 12 functions as an illuminated sight for aligning and sighting arrow trajectory with a target in dim light. By operation of the switch wheel 46 the LED 26 can be turned on and off to provide an inconspicuous switchable light source, visible only from the archer's point of view, which can be used to help the archer aim in dim light.

Rotation of the switch wheel 46 by the archer turns the cam shaft 48 to selectively connect and disconnect the battery 40 from the LED 26. When the cam surface 52 of the cam shaft 48 is turned upward, the spring 38 forces the battery 40 downward to make contact with the lead 28 of the LED 26. A continuous circuit is then completed from the lower end of the battery 40, through the lead 28, through the LED 26 and the lead 24, through the ring 16 and the body member 18, and through the cap 36 and spring 38 to the top of the battery 40. The internal resistance of the battery 40 is sufficient current-limiting to prevent damage to the LED 26, without the need for a current-limiting resistor in the circuit. Further turning of the wheel 46 then rotates the cam shaft 48 to move the cam surface 52 away from the battery 40, thereby lifting the battery 40 upward with the rounded part of the cam shaft 48. Since the lead 28 of the LED rests in the channel 50 as the cam shaft 48 is turned, contact between the lead 28 and the battery 40 is broken and the LED 26 goes out.

The bowsight 12 of the present invention offers several significant advantages over prior art devices. Firstly, the bowsight 12 by virtue of the LED 26 offers an illuminated sight that is relatively small and inconspicuous and yet is readily visible to the archer even in very dim light conditions. It is an additional advantage of the LED 26 that, since it is formed on a substrate, that none, or very little, of the light emitted by the LED is emitted in the direction of the target, thus not revealing the position of the archer to potential prey.

Furthermore, the electrical circuit for switchably activating the LED 26 is extremely simple, thereby making the bowsight 12 very easy to assemble and highly durable and reliable. Since the battery 40 is the one moving part, and since the lead 28 of the LED 26 is stationary, there are no fragile moving parts or contacts subject to breakage due to wear.

It is an additional advantage of the structure of the present invention in that the switch as described inherently includes tactile feedback. As the cam shaft 48 is turned to operate the switch, the cam surface 52 is rotated until it is adjacent the other lead 28 of the LED 26, and the nature resiliency of the other lead 28 causes it to snap in place against the cam surface 52. This snapping can be felt through the switch member 44 by the user. In addition, visual feedback can be supplied to the user by means of an indicating arrow or other switch position indicating means which may be embossed, printed, or molded onto the larger face of the switch wheel 46.

It is further envisioned that the sighting ring 16 may be used as a range finder for determining distance from the archer to the game or target. By adjusting the diameter of the sighting ring 16, it is possible that the archer can use that size as a bench mark to determine the approximate distance to game or a target. This is possible inasmuch as game of an identical size will appear to be smaller when viewed through the sighting ring 16 when farther away, and will appear to be larger, thus filling the sighting ring 16, when closer. The size of the sighting ring 16 can be adjusted so that the desired game will just fill the sighting ring 16 from the archer's viewpoint at a preselected distance. By then determining whether the game is smaller or larger then the apparent size of the sighting ring 16, as determined from the archer's viewpoint, the archer can determine whether the game is indeed farther away or closer than that predetermined distance. This information is extremely useful to an archer who must adjust his aim upward or downward to correct to the normal parabolic flight of an arrow from the bow.

It is understood that my invention is not limited to the particular construction and arrangement of parts disclosed and illustrated herein, but embraces all modified forms as come within the scope of the following claims.

I claim:

1. An illuminated bowsight comprising:

a. a body member having a cavity defined therein;

b. mounting means attached to the body member for mounting the bowsight on the bow;

c. a circular sighting ring attached to the body member;

d. a battery received in the cavity in the body member; and e. a light-emitting diode having two leads and mounted on the bowsight so as to be positioned in the center of the circle of the sighting ring with the leads being mechanically connected to the sighting ring to fasten the light-emitting diode in position, the light-emitting diode being electrically connected to the battery to provide a visible sighting mark in dim light.

2. An illuminated bowsight as claimed in claim 1 wherein the light-emitting diode has two leads, one of the leads being electrically and mechanically connected to the sighting ring, the other lead being electrically connectable to the battery.

3. An illuminated bowsight as claimed in claim 2 wherein the other lead of the light-emitting diode extends through a portion of the body member and is electrically insulated from the body member.

4. An illuminated bowsight as claimed in claim 3 wherein the other lead of the light-emitting diode is insulated from the body member by an insulating sleeve received over the other lead where it is received through the body member.

5. An illuminated bowsight as claimed in claim 2 wherein the other lead extends into the cavity in the body member to make electrical contact with the battery.

6. An illuminated bowsight as claimed in claim 5 further including a cap closing the end of the cavity and a compression spring disposed between the cap and the battery to urge the battery against the other lead of the light-emitting diode.

7. An illuminated bow sight as claimed in claim 1 wherein the sighting ring is sized so as to correspond to the apparent size of a desired target at a predetermined distance from the archer so that the sighting ring may be used as a range finder by the archer.

8. An illuminated bowsight comprising:

a. a body member having a cavity defined therein;

b. mounting means attached to the body member for mounting the bowsight on a bow;

c. a battery received in the cavity in the body member;

d. a light-emitting diode extending from the body member so as to be positioned in the line of sight of the archer the light-emitting diode having two leads, one of which is electrically and mechanically connected to the body member and the other of which is selectively connected to the battery; and e. a manually operated switch mounted in the body member for selectively connecting the battery to the other lead of the light-emitting diode to illuminate the light-emitting diode to serve as a sighting mark in dim light.

9. An illuminated bowsight as claimed in claim 7 wherein a sighting ring is attached to the body member and the light-emitting diode is centrally positioned in the sighting ring.

10. An illuminated bowsight as claimed in claim 8 wherein the other lead of the light-emitting diode extends through the body member into the cavity therein, and wherein an insulating sleeve received over the other lead electrically insulates the other lead from the body member.

11. An illuminated bowsight as claimed in claim 10 wherein an insulating sleeve surrounds the other lead of the light-emitting diode as it passes through the body member into the cavity.

12. An illuminated bowsight as claimed in claim 10 wherein the switch selectively connects the battery to the other lead of the light-emitting diode by selectively moving the battery into and out of contact with the other lead.

13. An illuminated bowsight as claimed in claim 11 wherein the switch includes a cam shaft extending through the body member, the cam shaft having a cam surface thereon so as to selectively allow contact between the battery and the other lead of the light-emitting diode.

14. An illuminated bowsight as claimed in claim 12 wherein the cam shaft has a channel formed in it extending about its periphery and wherein the other lead of the light-emitting diode is received in the channel so as to only contact the battery when the cam surface of the cam shaft is oriented toward the battery.

15. An illuminated bowsight as claimed in claim 12 wherein a switch wheel is connected to the cam shaft so that the cam shaft may be manually turned.

16. An illuminated bowsight as claimed in claim 11 wherein a cap is securely fastened in the cavity and wherein a compression spring is held between the cap and the battery to urge the battery against the cam shaft.

17. An illuminated bowsight as claimed in claim 7 wherein the mounting means is a threaded shaft extending from the body member.

* * * * *